US005465845A

United States Patent [19]

Norby et al.

[11] Patent Number: 5,465,845

[45] Date of Patent: Nov. 14, 1995

[54] GROCERY BAG DISPENSING AND LOADING SYSTEM

[75] Inventors: Allen J. Norby; Randolph D. Prader, both of Fairport, N.Y.

[73] Assignee: Mobil Oil Corporation, Fairfax, Va.

[21] Appl. No.: 194,787

[22] Filed: Feb. 9, 1994

Related U.S. Application Data

[63] Continuation of Ser. No. 62,028, May 17, 1993, abandoned, which is a continuation of Ser. No. 607,941, Nov. 1, 1990, abandoned.

[51] Int. Cl.[6] ..... B65D 85/62

[52] U.S. Cl. ..... 206/554; 383/37

[58] Field of Search ..... 383/8, 9, 37; 206/554; 248/99, 100, 101

[56] References Cited

U.S. PATENT DOCUMENTS

| | | | |
|---|---|---|---|
| Re. 33,264 | 7/1990 | Baxley et al. | 206/554 |
| 558,291 | 4/1896 | Lynham | 206/554 |
| 3,353,661 | 11/1967 | Membrino | 206/526 |
| 3,646,723 | 3/1972 | Meroney | 383/9 |
| 3,782,073 | 1/1974 | Musser | 206/554 |
| 4,137,958 | 2/1979 | Golby et al. | 206/554 |
| 4,316,353 | 2/1982 | Suominen | 248/100 |
| 4,368,765 | 1/1983 | Larkin et al. | 383/9 |
| 4,480,750 | 11/1984 | Dancy | 206/554 |
| 4,493,419 | 1/1985 | Prader et al. | 206/554 |
| 4,676,378 | 6/1987 | Baxley et al. | 206/554 |
| 4,759,742 | 7/1988 | Achelpohl | 383/37 |
| 4,796,759 | 1/1989 | Schisler | 383/37 |
| 4,811,417 | 3/1989 | Prince et al. | 206/554 |
| 4,989,732 | 2/1991 | Smith | 383/37 |
| 4,995,860 | 2/1991 | Wilfong, Jr. | 206/554 |

FOREIGN PATENT DOCUMENTS

| | | | |
|---|---|---|---|
| 2427982 | 2/1980 | France | 383/37 |
| 2159493 | 12/1985 | United Kingdom | 383/37 |

*Primary Examiner*—Allan N. Shoap
*Assistant Examiner*—Christopher J. McDonald
*Attorney, Agent, or Firm*—Alexander J. McKillop; Malcom D. Keen; L. Gene Wise

[57] ABSTRACT

The invention involves a system for bag pack support, easy dispensing, loading and removal of grocery bags involving a pack of bags and a rack suitable for the dispensing of the bags. The pack includes a plurality of undershirt type bags having integrally extended double-loop handles in the bag mouth. Each bag mouth is distinguished by being free of any suspension tabs. Thus, in bag pack form there is no "header". Suspension orifices are located in the handles of the bags. The pack of bags is employed with a rack which includes a pair of spaced parallel cantilevered rods having free ends. The bag pack is threaded onto the support rods by means of the support orifices. The rack includes a restraining means adapted to engage at least some of the bags of the pack so as to at least inhibit any significant forward movement of the pack as individual bags are loaded and removed from the rack. Means are included with the bag pack to secure the plurality of bags in a registered condition.

17 Claims, 1 Drawing Sheet

GROCERY BAG DISPENSING AND LOADING SYSTEM

This is a continuation of pending application Ser. No. 08/062,028, filed on May 17, 1993 and now abandoned which is a continuation of application Ser. No. 07/607,941, filed on Nov. 1, 1990 and now abandoned.

The present invention is concerned with a system for grocery bag pack support, easy dispensing, loading and removal of the loaded grocery bag from the system.

BACKGROUND OF THE INVENTION

At least since the early 1980s, when plastic grocery sacks promised to be a viable alternative for kraft paper grocery sacks, these plastic bags were manufactured in layflat stacks of bags and held together by means of a "header" at the region of the bag mouths. Even more recently, for example in Baxley U.S. Pat. No. 4,676,378 and its U.S. Pat. No. Re. 33,264, the inventors employ the prior art technique of utilizing a bag pack header in the formation of their bag packs, see e.g., FIG. 1, item 15. During the formation of packs of bags, a bag mouth and handle cutout remove plastic from one end of a stack of so-called end-sealed gusseted pillowcases. In order to maintain the plurality of stacked bags in a more or less fixed, stacked condition, extensions at the top center of the bag mouths are fastened together so that 50, 75, 100 or 125, etc., bags are bonded together. This bonded extension is known in the art as a "header". The individual tab extensions are connected by a line of perforations to the bag mouth region of each bag. As bags are serially used up at the front end of a supermarket, there remains, after the last bag has been used, the bonded header which ends up being discarded as waste. The header of a bag pack would amount to a significant savings source if a bag pack, or a bag pack and system, could be devised which eliminates the need for a header and yet would not adversely impact the handling of bag packs and/or the effective dispensing of bags because of bag misalignment at the supermarket.

Thus, it is an object of the present invention to eliminate the need for a header in the manufacture of thermoplastic film grocery bag packs.

It is another object of the present invention to present a system for effective bag pack support, easy dispensing, loading and removal of headerless grocery bags from the system.

SUMMARY OF THE INVENTION

The system of the present invention comprises, in combination:

(a) a pack of a plurality of stacked thermoplastic film undershirt-type grocery bags, each bag comprising front, rear, gusseted side walls, a closed bottom and an open-mouth top portion, said open-mouth portion being free of any integral extension header of the film at the top center of the front and rear walls; said top portion having a pair of spaced double-film loop handles as integral extensions of said walls at opposite ends of said mouth, said handles having support orifices in association therewith located between the top and base of said handles;

(b) a rack for said bag pack comprising a pair of spaced, parallel cantilevered support rods having free outer ends, said rods functioning to (1) support said bag pack from the support orifices of said handles, (2) permit expansion of the loop handles thereby separating the front wall from the rear wall of a lead bag and (3) facilitate removal of loaded bags by sliding said handles off said support rods; and (c) a restraining means in association with said rack, said means engaging at least some of the bags of said pack so as to be effective to at least inhibit any significant movement of the pack in the direction of individual bag removal.

It is to be understood that there can be more than one restraining member in association with the rack.

DETAILED DESCRIPTION OF THE INVENTION

Figure 1:
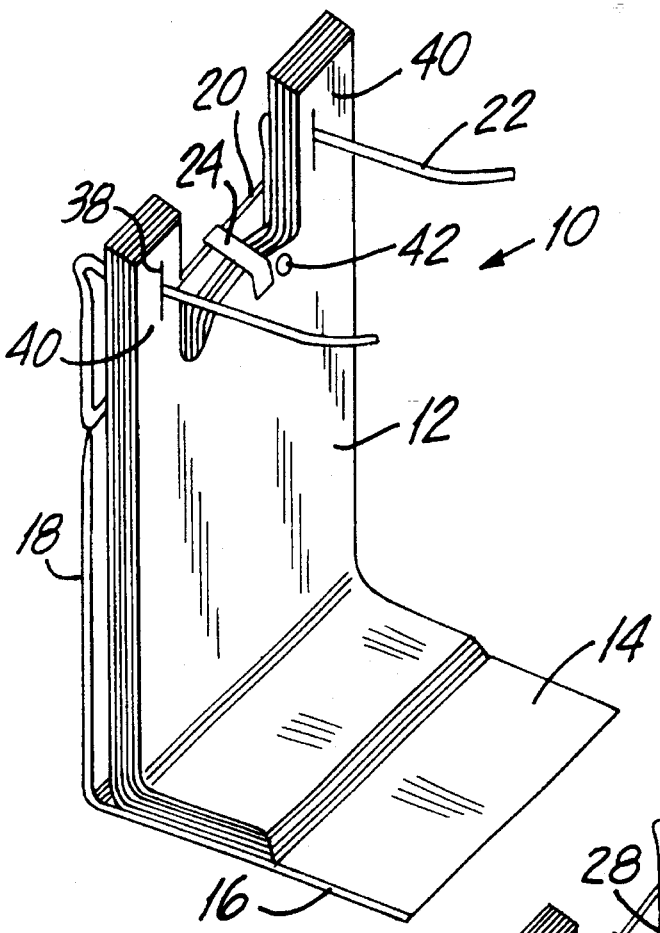
FIG. 1 is a perspective view of the subject system showing a bag rack suspending a bag pack and featuring centrally thereof a bag pack restraining means.

The present invention is concerned with a system or the way in which a combination of a bag pack rack and a grocery sack pack is effectively utilized in an environment such as the front end of a supermarket. The contemplated thermoplastic film grocery bag packs are, in their essential features, well known. The individual bags are constructed of a thin film of thermoplastic material such as polyethylene or a copolymer of ethylene and another alpha-olefin. This copolymer material is commonly known as LLDPE. This material and high-density polyethylene are the most common film employed for grocery sacks. The individual bags have side gussets that yield double-film loop handles during a cutout technique which forms the top bag mouth and handles of the bag. The bags are normally manufactured in bag pack combinations of registered bags numbering anywhere from 50 to 200 bags per pack. The bag packs contemplated herein will have an appropriate means in association with the handles so that the bag packs can be suspended from the handles at a point about intermediate the top of the handle and the base of the handle. This can be accomplished with bag pack structures such as those shown in U.S. Pat. Nos 4,493,419, Prader et al., 4,480,750, Dancy, 4,676,378 and its U.S. Pat. No. Re., 33,264, Baxley et al., 4,811,417, Prince et al., etc. All of these bag packs include a suspension orifice in association with the handles. It is intended that the handles of bag packs of this type be threaded onto two elongated parallel cantilevered support rods in order to maintain the bag pack in an upright position by suspension from the handles. The reason that the handle orifices are located at an approximate midway position between the top of the handles and the base of the handles, is that this permits the loops of the handles to be extended from a flattened position to an expanded position while still being suspended from the support rods. This is important because by this structural arrangement and combination, the front panel of the lead bag can be separated from the back panel of the lead bag so that the supermarket bagger can easily access the mouth entrance of each bag.

In its basic essentials, the rack to be used with the bag packs of the present invention must have two spaced parallel cantilevered support rods located so as to receive the handles of the bag pack and maintain the bag pack in an upright position for easy access by a supermarket bagger.

In accordance with the present invention, the bag packs contemplated herein do not contain and are free of the prior art "header" tabs seen in many prior art patents such as Baxley et al., 4,676,378. As indicated above, this "header" comprises the overall collection of tab extensions connected to the front and the rear central region of each bag mouth, which is bonded together and includes an orifice somewhere in the central region thereof. The individual tabs which make up the "header" are connected usually by a line of perforations at the bag mouth. This permits individual bags to be torn free of the header serially. After all the bags have been torn free of the header, this header is discarded. This accounts for a significant waste of material.

Referring to FIG. 1, there is shown a rack and bag pack system 10 having a pack 12 of a plurality of bags suspended from a bag pack rack 14. Rack 14 includes a rack baseplate 16. Extending upwardly from the baseplate are a pair of spaced vertical rods 18. The vertical rods carry a cross-brace 20. Cantilevered from vertical rods 18 are support rods 22. Centered approximately midway of the cross-brace 20 is a restraint means 24. As shown, restraint means 24 can be a flat member having a right angle downwardly-disposed bend at the end thereof. This rack is designed to function with a pack of thermoplastic grocery sacks, the individual bags of which include the following structure: a front bag wall 26, a rear bag wall 28, opposed gusseted sidewalls 30, a closed bottom 32, an open mouth top 34, double-film loop handles 36 and in the handles about midway between the top of the handle seal and the base of the handle are support orifices 38. In order to maintain the plurality of stacked bags in a more or less orderly stacked registration, various means can be used in order to releasably fix the bags in such registration. One means of accomplishing this is to employ a hot needle and releasably tack each adjacent handle region together throughout the bag pack. This effectively keeps the handles together and, thus, the bags of the bag pack in registration. This is illustrated at point 40 in FIGS. 1 and 2. An alternative or cumulative technique for temporarily fixing this registration is, during the formation of the support orifices 38 adjacent films become somewhat inter-confused physically so that the bag films in this region tend to remain together until some moderate force separates them. In addition, an alternative or, again, cumulative technique of maintaining the bags in registration is to releasably adhesively bond adjacent outside film layers together such as by providing for adhesion either in the handles or in the bag mouth region. This is illustrated at area 42 in FIGS. 1 and 2. This can be applied by employing a topical, low-aggression adhesive, or by ensuring that corona discharge has occurred in this region coupled with sufficient pressure to cause the adjacent surfaces to lightly adhere together.

Figure 2:
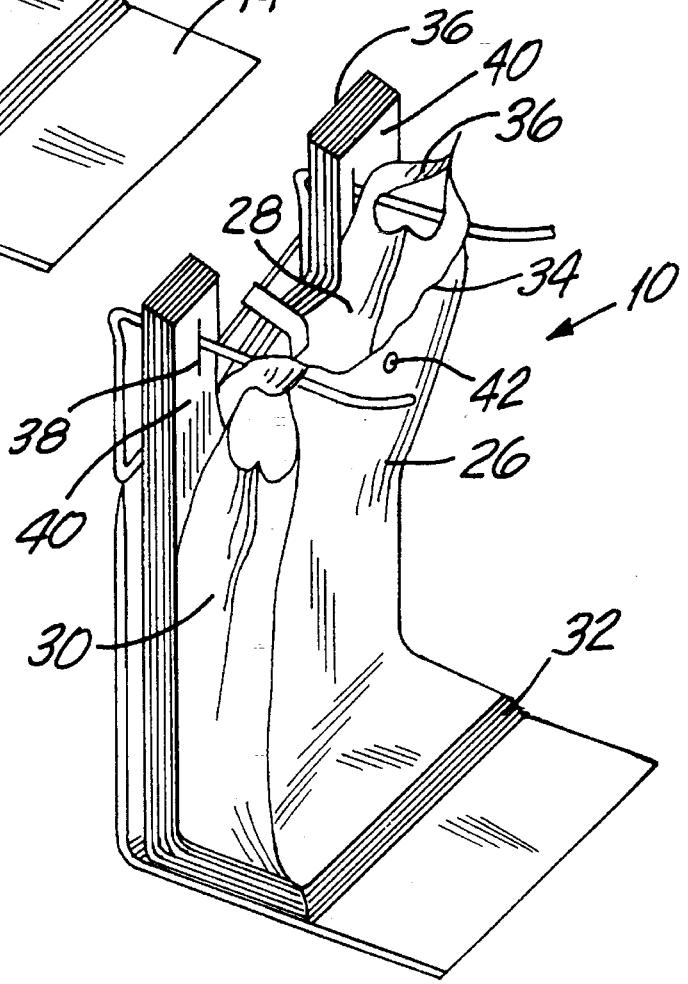
FIG. 2 shows the system of FIG. 1 with the lead bag deployed into a position for receiving items by a bagger.

FIG. 1, as indicated above, shows the system in a standby condition ready to be employed in the bagging of groceries in the front end of a supermarket. The length of the support rods 22 must be sufficient to permit expansion of the loop handles 36 as shown in FIG. 2. In operation, the bagger accesses the front panel of the lead bag of the pack and draws it forward a short distance as shown in FIG. 2. During this operation, restraint means 24 operates to resist any movement in the direction of the draw and causes the front panel at the bag mouth to separate from the rear panel at the bag mouth and also to expand or open the handle loops. Thus, with one swipe of the hand this positions the lead bag in a ready position for the bagging of supermarket articles.

The restraint means 24 performs the function of holding back the top center of the bag pack, thus preventing all or some of the bag pack from sliding forward as the bagger exerts a pulling force on the lead bag. It is to be understood that the restraint means 24 shown need not extend beyond the lead bag but may provide its resistance to bag pack movement by having the downwardly-dependent portion of 24, as little as one-quarter of the way into the bag pack thickness and still provide sufficient resistance to permit separation of the front and rear bag panels at the bag mouth. Furthermore, the restraint means need not be at the bag mouth but can be positioned somewhere near the upper region of the vertical rods on both sides and thus effectively restrain any forward movement of the bulk of the handles of the bag pack. This also will effectively prevent movement of the bag pack. The number and actual design of the restraint means is not important so long as the structure will prevent forward movement of the bag pack.

FIGS. 1 and 2 reveal several means for releasably maintaining the bags in registration to facilitate easy suspension of the pack from the support orifices 38. These means are shown at 40 where a hot needle has releasably bonded adjacent film layers together; adhesive area 42 shown at a region near the bag mouth; and the support orifices 38. These means also have an important secondary function. For example, the hot needle bonded area not only tends to keep the handles and therefore the bag pack in registration, but as a bag is removed from the pack, the bonding force between the departing bag and the next bag in succession is sufficient to cause the succeeding bag in the heat-bonded area to want to follow along at least a short distance before the departing force overcomes the lightly adhesive force. This tendency is beneficial because the result is that the next succeeding bag is partially in an open position rather than a layflat or collapsed condition. In a collapsed, layflat condition, the bagger will find access to the mouth entrance of the bag a little more difficult than if the top of the bag were partially open. Thus, when this more or less automatic partial opening occurs, more efficient utilization of the dispensing system results. The same is true of the orifices 38. These orifices are usually made by some type of cutting or piercing instrument which tends to inter-confuse the orifices' edges, one layer to the next, with the result that the attempt to separate one film of the bag by pulling on it, alone results in the next succeeding film tending to follow along, thus also assisting in partially opening the next succeeding bag. Likewise, by placing an adhesive condition, such as that shown at 42, on the front wall of each bag near the bag mouth or at the rear wall near the bag mouth or in both locations, not only does this assist in maintaining the bags in effective registration, but on overcoming the adhesive contact between films, the next succeeding bag in the bag mouth region is effectively opened. This will occur in spite of the location of restraining means 24. Restraining means 24 can be positioned as shown in FIGS. 1 and 2 and, in spite of this location, on removal of the lead bag, the next succeeding bag will tend to partially open as a result of the adherence between the departing bag and the next succeeding bag due to the adhesion described above at 40, 38 and/or 42.

The bag packs described herein may be prepared by any process or system which will result in the defined bag packs. One suitable technique can be described as follows:

A thermoplastic tube, for example, of a polyethylene film, is flattened and gusseted so that the gussets extend inwardly from the sides to an extent such as is suggested by FIG. 2. Thereafter, the gusseted tube is sealed transversely along spaced lines which ultimately constitute the seals at the ends of the handles and at the bottom of the bag. By this technique, a series of interconnected "pillowcases" is continuously formed.

After separation and stacking, a suitable mechanism will cut out one end of the pillowcase stack to form the double-film loop handles and the bag mouth region of the bags. At the same time or thereafter, a suitable mechanism will form the suspension orifices through all of the layers of each of the handles. This device can be a simple piercing knife which forms a straight line slit in the handles. A circular punch, alternatively, may create holes all the way through a region midway between the top and the base of the handles. Also, simultaneously or sequentially, the layers of the handles may be lightly heat-sealed together by means of a hot needle passing through all the films. During formation of the pillowcases, adhesive region 42 can be applied so that it will be adjacent to bag mouth 34 after the handle cutout and bag mouth is created.

By this technique, bag packs are adapted to be received by the above-described bag rack. Thus, the system of the present invention advances the art by eliminating the need for any centrally-located header with the consequent savings in raw material and elimination of the creation of one more aspect of environmental waste. The described system accomplishes these advantages while still providing a facile system for utilizing thin film plastic grocery sacks in a supermarket environment.

Thus, while there have been described what are presently believe to be the preferred embodiments of the present invention, other and further modifications and changes may be made without departing from the true spirit of the invention, and it is intended to claim all such changes and modifications which come within the true scope of the invention.

What is claimed is:

1. A system for bag pack support, easy dispensing, loading and removal of grocery bags comprising in combination:

a) a pack of a plurality of stacked thermoplastic film undershirt type grocery bags, each bag comprising front, rear, gusseted side walls, a closed bottom and an open mouth top portion, said open mouth portion being free of any integral extension header of the film at the top center of the front and rear walls; said top portion having a pair of spaced double film loop handles and integral extensions of said walls at opposite ends of said mouth, said handles support orifices in association therewith located between the top and base of said handles;

b) a rack for said bag pack comprising a pair of horizontal parallel support rods having free outer ends cantilevered from a pair of vertical rods, said vertical rods extending upwardly from a base plate, said horizontal rods functioning to (1) vertically support said bag pack from the support orifices of said handles, (2) permit expansion of the loop handles thereby separating the front wall from the rear of a lead bag and (3) facilitate removal of loaded bags by sliding said handles off said support rods;

c) a cross brace having a midpoint, a first end and a second end extending between said pair of vertical rods; and d) a restraining means in association with said rack, said restraining means comprising at least one restraining member having a first and second end, wherein said first end is fixed to said cross brace, said restraining member consisting essentially of a flat member shaped and positioned with said second end downwardly disposed so as to extend beyond and over the open top mouth of at least some of the bags to thereby contact said front of at least some of the bags and cause some opposing resistance to horizontal movement of the pack during bag mouth opening of a lead bag of the pack.

2. The system of claim 1 wherein said restraining member in profile resembles at least approximately a right angle.

3. The system of claim 1 wherein said restraining member is located at the midpoint of said cross brace and resists movement at the bag mouth region of the bag pack.

4. The system of claim 1 wherein said restraining means resists movement at the handles of the bag pack.

5. The system of claim 1 wherein the pack of bags includes at least one means for releasably maintaining the bags in registration to facilitate easy suspension of the pack from said support orifices.

6. The system of claim 5 wherein said registration maintaining means includes releasably heat-bonding together the adjacent film layers of the handles of adjacent bags in comparatively small areas.

7. The system of claim 5 wherein said registration maintaining means includes releasably adhesively bonding together comparatively small areas of adjacent handles and/or of the bag mouth region.

8. The system of claim 1 wherein said restraining means consists essentially of two restraining members positioned at opposing ends of said cross brace.

9. A method for easy dispensing, loading and removal of grocery bags comprising:

a) forming a pack of a plurality of stacked thermoplastic film undershirt type grocery bags, each bag comprising front, rear, gusseted side walls, a closed bottom and an open mouth top portion, said open mouth portion being free of any integral extension header of the film at the top center of the front and rear walls; said top portion having a pair of spaced double film loop handles as integral extensions of said walls at opposite ends of said mouth, said handles having support orifices in association therewith located between the top and base of said handles;

b) forming a rack for said bag pack comprising a pair of horizontal parallel support rods having free outer ends cantilevered from a pair of vertical rods, a cross brace having a midpoint, a first end and a second end, and a base plate, said vertical rods extending upwardly from said base plate, said horizontal rods functioning to (1) vertically support said bag pack from the support orifices of said handles, (2) permit expansion of the loop handles thereby separating the front wall from the rear wall of a lead bag and (3) facilitate removal of loaded bags by sliding said handles off said support rods; and c) forming a restraining means in association with said rack comprising at least one restraining member having a first and second end, wherein said first end is fixed to said cross brace, said restraining member consisting essentially of a flat member, shaped and positioned with said second end downwardly disposed so as to extend beyond and over the open top mouth of at least some of the bags to thereby contact said front of at least some of the bags and cause some opposing resistance to horizontal movement of the pack during bag mouth opening of a lead bag of the pack.

10. The method of claim 9 wherein said restraining member in profile resembles at least approximately a right angle.

11. The method of claim 9 wherein said restraining member is located at the midpoint of said cross brace and resists movement at the bag mouth region of the bag pack.

12. The method of claim 9 wherein said restraining means resists movement at the handles of the bag pack.

13. The method of claim 9 wherein the pack of bags includes at least one means for releasably maintaining the bags in registration to facilitate easy suspension of the pack from said support orifices.

14. The method of claim 11 wherein said registration maintaining means includes releasably heat-bonding together the adjacent film layers of the handles of adjacent bags in comparatively small areas.

15. The method of claim 11 wherein said registration maintaining means includes releasably adhesively bonding together comparatively small areas of adjacent handles and/or of the bag mouth region.

16. The method of claim 9 wherein said restraining means consists essentially of two restraining members positioned at opposing ends of said cross brace.

17. A system for bag pack support, easy dispensing, loading and removal of grocery bags comprising in combination:

a) A pack of a plurality of stacked thermoplastic film undershirt type grocery bags, each bag comprising front, rear, gusseted side walls, a closed bottom and an open mouth top portion, said open mouth portion being free of any integral extension header of the film at the top center of the front and rear walls; said top portion having a pair of spaced double film loop handles as integral extensions of said walls at opposite ends of said mouth, said handles having support orifices in association therewith located between the top and base of said handles;

b) a rack for said bag pack comprising a pair of horizontal parallel support rods having free outer ends cantilevered from a pair of vertical rods, said vertical rods extending upwardly from a horizontal base plate, said horizontal rods functioning to (1) vertically support said bag pack from the support orifices of said handles, (2) permit expansion of the loop handles thereby separating the front wall from the rear wall of a lead bag and (3) facilitate removal of loaded bags by sliding said handles off said support rods;

c) a horizontal cross brace extending between said pair of vertical rods; and d) a restraining member in association with said rack, said restraining member having a first and a second end, wherein said first end is fixed to said horizontal cross brace midway between said vertical rods and consisting essentially of a flat member extending horizontally and outwardly from said cross brace and having a right angle downwardly disposed bend at said second end, said restraining member extending beyond and over the open top mouth of at least some of said bags to thereby contact said front of at least some of said bags and cause some opposing resistance to horizontal movement of said pack during bag mouth opening of a lead bag of said pack.

* * * * *